US008408398B2

(12) United States Patent
Yui

(10) Patent No.: US 8,408,398 B2
(45) Date of Patent: Apr. 2, 2013

(54) SHEET HANDLING SYSTEM

(75) Inventor: Akihiro Yui, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/935,733

(22) PCT Filed: Apr. 22, 2010

(86) PCT No.: PCT/JP2010/002915

§ 371 (c)(1),
(2), (4) Date: Sep. 30, 2010

(87) PCT Pub. No.: WO2010/125774

PCT Pub. Date: Nov. 4, 2010

(65) Prior Publication Data

US 2012/0031817 A1 Feb. 9, 2012

(30) Foreign Application Priority Data

Apr. 27, 2009 (JP) ..... 2009-108350

(51) Int. Cl.
*B07C 5/00* (2006.01)

(52) U.S. Cl. ..... 209/534; 700/223; 194/206; 705/43

(58) Field of Classification Search ..... 209/534; 700/223; 705/43; 194/206; 382/135, 190
See application file for complete search history.

(56) References Cited

U.S. PATENT DOCUMENTS

| | | | | |
|---|---|---|---|---|
| 5,659,628 | A * | 8/1997 | Tachikawa et al. | 382/135 |
| 6,065,672 | A * | 5/2000 | Haycock | 235/379 |
| 6,560,355 | B2 * | 5/2003 | Graves et al. | 382/135 |
| 6,724,926 | B2 * | 4/2004 | Jones et al. | 382/135 |
| 7,724,938 | B2 * | 5/2010 | Pareskevakos | 382/135 |
| 7,978,899 | B2 * | 7/2011 | Jenrick et al. | 382/135 |
| 7,980,378 | B2 * | 7/2011 | Jones et al. | 194/217 |
| 8,155,423 | B2 * | 4/2012 | Kagehiro et al. | 382/135 |
| 2001/0006556 | A1 * | 7/2001 | Graves et al. | 382/135 |
| 2004/0062430 | A1 | 4/2004 | Buntscheck | |

FOREIGN PATENT DOCUMENTS

| | | |
|---|---|---|
| EP | 1 783 698 | 5/2007 |
| GB | 2 000 487 | 1/1979 |
| JP | 2004-303130 | 10/2004 |
| JP | 2007-087219 | 4/2007 |
| JP | 2008-250530 | 10/2008 |
| WO | WO 99/23601 | 5/1999 |

OTHER PUBLICATIONS

European Search Report dated Feb. 1, 2013, PCT/JP2010002915.

* cited by examiner

*Primary Examiner* — Joseph C Rodriguez
(74) *Attorney, Agent, or Firm* — Pillsbury Winthrop Shaw Pittman, LLP

(57) ABSTRACT

A sheet handling system is provided in which sheet handling apparatuses and a central apparatus are network connected and which can set a discrimination level of each of the sheet handling apparatuses from the central apparatus.

The sheet handling apparatus has selection means which can select any one of a genuine note, a damaged note, a rejectable note, automatic setting and on-line setting, and setting means which requests the central apparatus to transmit a discrimination level when the on-line setting is selected, receives the transmitted discrimination level and sets a discrimination level. The central apparatus has selection means which can select any one of the genuine note, the damaged note, the rejectable note, and the on-line setting, and setting means to set automatically a discrimination level based on detection data received from the sheet handling apparatus in a case that the on-line setting is selected, and transmits the relevant discrimination level when the transmission request for the discrimination level is made.

3 Claims, 7 Drawing Sheets

SHEET HANDLING SYSTEM

CROSS-REFERENCE TO RELATED APPLICATIONS

This is the U.S. National Stage of PCT/JP2010/002915, filed Apr. 22, 2010, which in turn claims priority to Japanese Patent Application No. 2009-108350, filed Apr. 27, 2009, the entire contents of both applications are incorporated herein by reference in their entireties.

TECHNICAL FIELD

The present invention relates to a sheet handling system in which a sheet handling apparatus to sort and handle sheets such as securities into a genuine note, a damaged sheet and a rejectable note is network connected to a central apparatus and a discrimination level of the relevant sheet handling apparatus is set from the relevant sheet handling apparatus or the central apparatus.

BACKGROUND ART

A sheet handling apparatus to handle sheets such as securities is an apparatus which conveys the supplied sheets, and discriminates the relevant sheets into an authentic bill (a genuine note and also a sheet capable of circulation), a damaged note (an authentic bill and also a sheet which can not be recirculated) and a rejectable note (a sheet except the genuine note or the damaged sheet) by a sheet discriminating apparatus.

The sheet handling apparatus is already used as a bill handling apparatus to handle bills, for example. With respect to the sheet handling apparatus, there are a case in which the supplied sheets are composed of a single type of note and a case in which the supplied sheets are composed of a plurality of types of note which are supplied in the mixed state regarding the type of note, the front or back side, and the direction. In any cases, the sheets supplied to a supply portion are taken out to a conveying path one by one by a taking out apparatus and are conveyed. The conveyed sheets are discriminated by a discriminating apparatus arranged along the conveying path.

The sheet discriminating apparatus discriminates the type of note, the front or back side, and the direction of the sheet to be conveyed. The sheets discriminated by the discriminating apparatus are counted based on the discrimination result, and are stacked by a stacking device arranged at the downstream in the conveying direction, or each time when the number of the stacked sheets reaches a prescribed number (100 sheets, for example) the sheets are bundled by a bundling material such as a paper belt to form a 100 sheets bundle and the bundle is then discharged.

Conventionally, an operator set a normal sheet/damaged sheet discrimination level of such the sheet handling apparatus from an operation display of the relevant sheet handling apparatus. In addition, an authenticity discrimination criteria updating system is known which updates the authenticity discrimination criteria of a value medium from a network connected data management apparatus (Refer to Patent Document 1, for example.).

PRIOR ART DOCUMENT

Patent Document

Patent Document 1: Japanese Patent Disclosure (Kokai) P2004-303130 (pages 8-9, FIG. 5-FIG. 6)

SUMMARY OF THE INVENTION

Problem to be Solved by the Invention

However, in a case that the above-described sheet handling apparatuses are arranged plurally at the same or different areas, there is a case that the normal sheet/damaged sheet sorting qualities of the sheets (the 100 sheets bundles, for example) to be handled by the relevant sheet handling apparatuses are not uniform. That is a case, for example, that the sheet which is discriminated as the genuine note in one sheet handling apparatus is discriminated as the damaged note in another sheet handling apparatus.

In addition, in order not to recirculate the damaged note usually, as supplying the authentic bill sheets with the amount corresponding to the amount of the sheets which are discharged as the damaged notes is required, there is a case in which to set the normal sheet/damaged sheet discrimination level politically in consideration of the economic status in the handling amount of the whole sheets is hoped. For the request, there was a problem that the expected effect can not be obtained by the conventional normal sheet/damaged sheet discrimination level setting for each of the sheet handling apparatuses.

The present invention was made to solve the above-described problem, in which sheet handling apparatuses are network connected to a central apparatus, and the discrimination results of sheets by sheet discriminating apparatuses of each of the sheet handling apparatuses are transmitted to the central apparatus. The central apparatus processes statistically the received normal sheet/damaged sheet discrimination results, and transmits a discrimination level generated based on the obtained result to the relevant sheet discriminating apparatuses. Providing a sheet handling system in which the sheet handling apparatuses can perform the normal sheet/damaged sheet discrimination of the relevant sheets to be handled based on the received discrimination level is made an object.

Means for Solving the Problem

A sheet handling system of the present invention is the sheet handling system in which sheet handling apparatuses and a central apparatus are installed at different premises via a network, and is characterized in that the sheet handling apparatus includes communication means connected to the network which can transmit and receive with the network, selection means in which an operator can select any one of a genuine note, a damaged note, a rejectable note, automatic setting and on-line setting for each of detection items to discriminate a sheet, first setting means to select the genuine note, the damaged note or the rejectable note selected by the selection means and to set a discrimination level for each of the genuine note, the damaged note or the rejectable note, second setting means to set automatically a discrimination level of the genuine note, the damaged note and the rejectable note based on detection data detected by the relevant sheet handling apparatus in a case that the automatic setting is selected, third setting means which requests the central apparatus to transmit a discrimination level, receives the discrimination level transmitted from the relevant central apparatus, and sets a discrimination level in a case that the on-line setting is selected, and sheet discriminating means to discriminate the sheet to be conveyed based on the discrimination level set by the first setting means, the second setting means or the third setting means, and the central apparatus includes communication means connected to the network which can transmit and receive with the network, selection means in which an operator can select any one of the genuine note, the damaged note, the rejectable note, and the on-line setting for each of detection items to discriminate the sheet, first setting means to select the genuine note, the damaged note or the rejectable note selected by the selection means and to set a discrimination level for each of the genuine note, the damaged note or the rejectable note, second setting means to set automatically a discrimination level of the genuine note, the damaged note and the rejectable note based on the detection data received from the sheet handling apparatus via the network in a case that the on-line setting is selected, selection means to select any one of the first setting means and the second setting means, and transmission means to transmit the discrimination level set by the setting means selected by the selection means when the transmission request for the discrimination level is made via the network from the sheet handling apparatus.

Effect of the Invention

As the discrimination level of the relevant sheet handling apparatus can be set from the central apparatus, the amount of the damaged notes for the whole handling amount can be set. In addition, by setting the discrimination level of the relevant handling apparatuses from the central apparatus, the variation of the qualities caused by that the discrimination levels are different for each of the sheet handling apparatuses can be suppressed.

EMBODIMENT TO PRACTISE THE INVENTION

In a sheet handling system of the present invention, a plurality of sheet handling apparatuses with the similar construction are connected to a central apparatus via a network. In such the construction, discrimination levels of the sheet can be unified by setting the discrimination level of the sheets to be handled in the relevant sheet handling apparatuses from the central apparatus. With respect to the embodiment to practice the present invention, the embodiment of the present invention will be described hereinafter with reference to the drawings.

Embodiment

Figure 1:
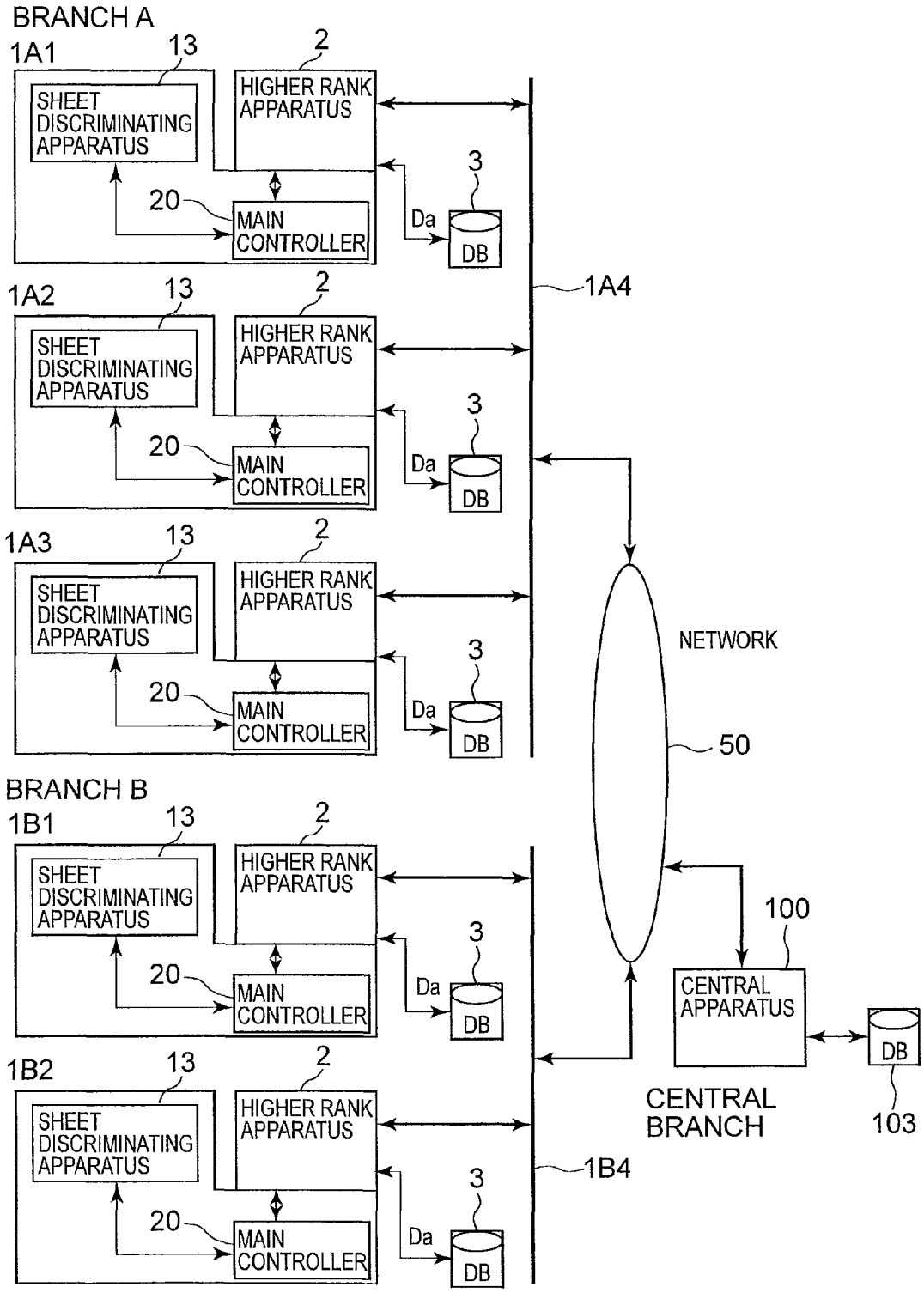
FIG. 1 is a block diagram of sheet handling apparatuses according to an embodiment which are network connected.

FIG. 1 is a sheet handling system showing a state in which sheet handling apparatuses according to a first embodiment of the present invention are connected to a network.

In a branch A, sheet handling apparatuses 1A1 to 1A3 which are respectively constructed in the same way as the above-described sheet handling apparatus with respect to the present invention portions are connected to a network 50 via an internal LAN 1A4. The above-description of "constructed in the same way" means that even if the sheet handling apparatuses in which handling speeds or the numbers of the stackers to stack the sheets to be handled are different depending on the use configuration, the sheet handling apparatuses can compose the present invention. Accordingly, here the sheet handling apparatuses are represented as the sheet handling apparatuses 1A1 to 1A3 based on a sheet handling apparatus 1. With respect to a branch B, the above-description is similarly applied.

In the branch B, sheet handling apparatuses 1B1, 1B2 are connected to the network 50 via an internal LAN 1B4.

In a central branch, a central apparatus 100 is installed, which is connected to the network 50.

The sheet handling apparatuses 1 such as the sheet handling apparatuses 1A1 to 1A3, and the sheet handling apparatuses 1B1, 1B2 are each composed of a sheet discriminating apparatus 13, a main controller 20, a database server 3 and a higher rank apparatus 2 and so on.

The higher rank apparatus 2 is connected to the main controller 20, and an operator can input an operation mode of the sheet handling apparatus 1 from an operation display provided in the higher rank apparatus 2. The operation mode inputted by the operator is transmitted from the higher rank apparatus 2 to the main controller 20, and a processing operation of the relevant sheet handling apparatus is set.

The operation mode setting set by the operator is to set the processing operation such as the kind of the sheet to be handled from now, setting of a normal sheet/damaged sheet discrimination level, and designation of the stacker.

For example, the relevant stacker can be designated according to the damaged note discrimination level or the kind of the damaged note, based on the discrimination result of the sheet discriminating apparatus 13 described later.

For example, in a case that the sheets to be handled are composed of the sheets of one kind, sorting the sheets into a genuine note which can be used by an ATM or the like, the other genuine note and a damaged note can be made, or sorting the damaged notes which are normal sheet/damaged sheet discriminated in the sheet handling apparatus further into the kinds can be made by reinserting the sheets discriminated as the damaged notes.

The main controller 20 conveys the sheet based on the processing operation instruction received from the higher rank apparatus 2, and transmits the discrimination result by the sheet discriminating apparatus 13 to the higher rank apparatus 2.

The higher rank apparatus 2 which functions as communication means performs statistical processing for the discrimination result received from the main controller 20, and transmits the result to the central apparatus 100 via the internal LAN 1A4, 1B4 and the network 50.

The central apparatus 100 accumulates the received data received from the sheet handling apparatus 1A1, for example, in a database server 103. The attribute of the sheet is included in the received data, such as the type of note and the number of the handled sheets, the discrimination result (the genuine note, the damaged note, the counterfeit note, the rejectable note), the normal sheet/damaged sheet data, the normal sheet/damaged sheet discrimination level, and the issued year.

The data accumulated in this manner are accumulated for each of the apparatuses, the branches or the areas, and a ratio of the genuine notes and the damaged notes, and a ratio of the counterfeit notes and so on are calculated and stored. These detected data are processed based on a statistical method. For example, after the accumulated normal sheet/damaged sheet discrimination data is normalization processed as described below, the normal sheet/damaged sheet distribution is generated, and the relevant distribution can be displayed on the operation display of the central apparatus 100.

In addition, the performance of the apparatus or the quality of the handled sheets can be grasped, by comparing these normal sheet/damaged sheet distributions for each of the sheet handling apparatuses installed at each site. In addition, a normal sheet/damaged sheet discrimination level can be generated by generating a normal sheet/damaged sheet distribution based on the normal sheet/damaged sheet detection data of all the sheets accumulated in this manner.

Figure 2:
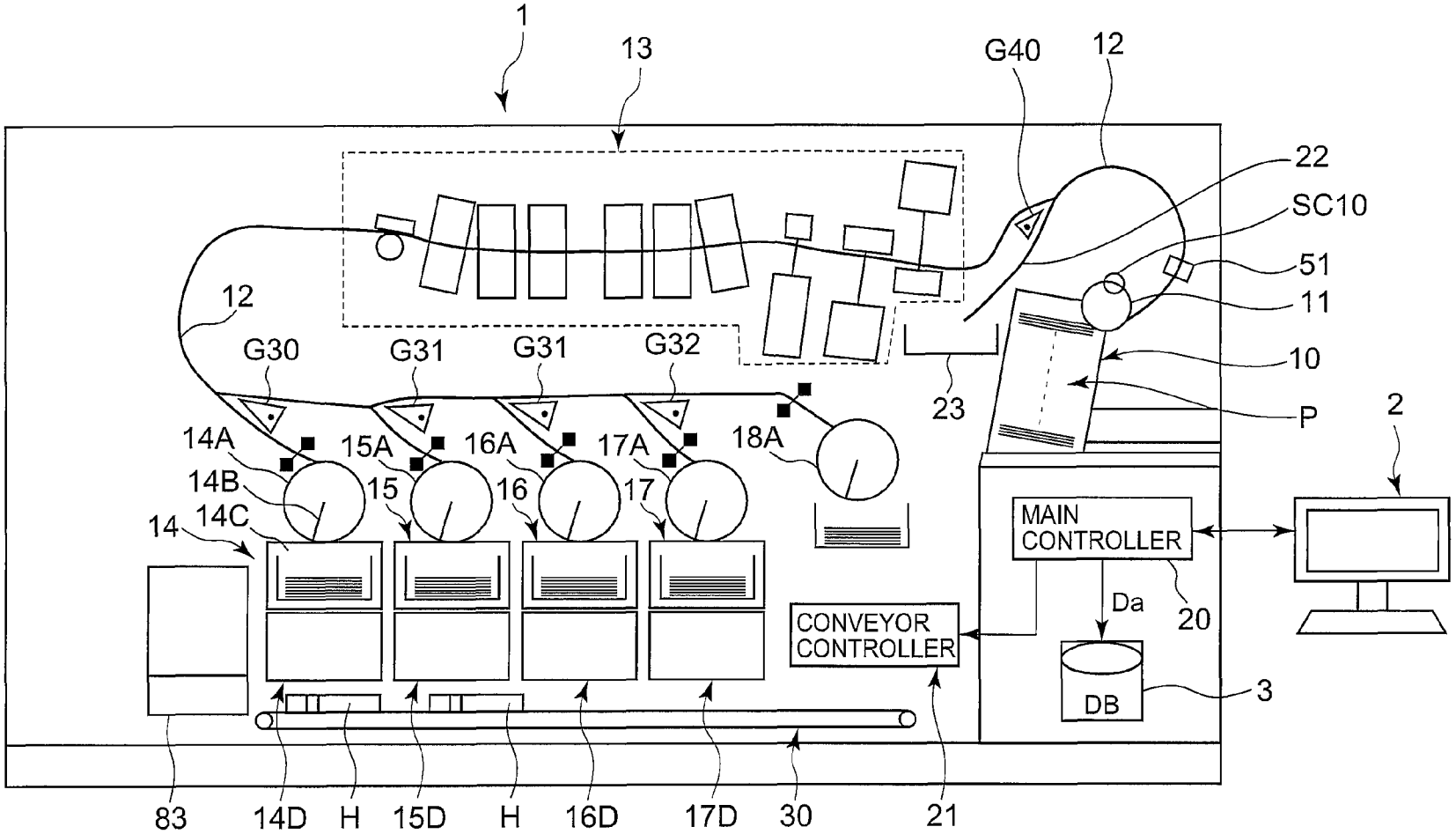
FIG. 2 is a schematic diagram of the sheet handling apparatus shown in FIG. 1.

FIG. 2 is a schematic construction view of the sheet handling apparatus 1 composing the sheet handling system shown in FIG. 1. The sheet handling apparatus 1 is an apparatus to sort the supplied sheets P into the genuine note, the damaged note or the rejectable note and then to stack or band.

The higher rank apparatus 2 is connected to the sheet handling apparatus 1, and an operator can input the information of the sheets to be handled in the relevant apparatus. For example, the number and the amount of money of the sheets of the handled sheets for each of the types of note, setting of the stacking device to stack the sorted sheets and the banding device, and setting of the normal sheet/damaged sheet discrimination level for each of the types of note can be performed. In addition, the handling amount of the sheets handled by the relevant apparatus can be displayed. In addition, the operation state and maintenance state of the apparatus and so on can be displayed.

The database server 3 is connected to the main controller 20 to control the sheet handling apparatus 1, and the discrimination result of the sheets handled by the relevant apparatus is written into the database server 3 by the main controller 20. The attribute of the sheet such as the type of the note and the number of the handled sheets, the discrimination result (the genuine note, the damaged note, counterfeit note, the rejectable note), the normal sheet/damaged sheet data, the normal sheet/damaged sheet discrimination level, and the issued year, and a ratio of genuine notes and the damaged notes, a ratio of the counterfeit notes calculated from these data are included in the database server 3.

FIG. 2 is a detailed view of the sheet handling apparatus 1 shown in FIG. 1. After the sheet information such as the type of note and the number of the sheets P to be handled and the credit source information is inputted to the sheet handling apparatus (an apparatus) 1 from the operation display of the higher rank apparatus 2, the sheets P based on the relevant information are supplied in a lump to a supply portion 10.

After the sheets P are supplied to the supply portion 10, when a start instruction to take in the apparatus is outputted, the sheet at the uppermost face of the sheets P supplied to the supply portion 10 is raised to the taking-out position of a take-out rotor 11 as a taking-out apparatus, and then the sheets P are taken out by the relevant taking-out apparatus from the sheet at the uppermost face to a conveying path one by one. The rotation of the take-out rotor 11 is detected by a sensor SC10, and the take-out rotor 11 takes out one sheet to the conveying path 12 at each time of one rotation. Therefore, the taken-out sheets are taken out with an approximately equal pitch, taking the tip of the sheets as a reference. (constant pitch taking out)

The sheet P taken out to the conveying path 12 in this manner is detected by a plurality of detecting apparatuses composing the sheet discriminating apparatus 13. The calculation process is performed between the detection data detected by the detecting apparatuses and the preliminarily set discrimination level or standard pattern, and with respect to the relevant sheet P, the type of note, the authenticity (whether genuine or counterfeit), the normal sheet/damaged sheet (whether a genuine note or a damaged note) and the direction (front or back, forward or reverse) are discriminated.

A discrimination information Da composed of the detection data and the discrimination result of the sheet discriminating apparatus 13 is transmitted to the main controller 20. The main controller 20 transmits the received discrimination result to a conveyor controller 21. The conveyor controller 21 performs switching control of the sorting gates based on the received discrimination result, and conveys the relevant sheet P to the final conveying place.

The sheet sorted and conveyed in this manner is taken in stacking/banding device 14 to 17 arranged at the terminal end of the relevant conveying path 12.

The stacking/banding device 14, for example, takes in the sheet which is sorted and conveyed between a blade and a blade of a rotating bladed wheel 14A, scrapes out the taken-in sheet while rotating by a scrape out bar 14B provided in the stacking/banding device 14, and stacks the sheet in a temporary stacker 14C.

The sheets stacked in the temporary stacker 14C are bundled by a bundling material such as a heat adhesive paper belt every time when the number of the sheets reaches 100 sheets to form a 100 sheets bundle H which is discharged to a conveyor 30 and then is sent to the next process. The stacking/banding devices 15 to 17 are each constructed in the same way as the stacking/banding device 14, and the description thereof will be omitted.

The main controller 20 transmits the discrimination information Da composed of the detection data and the discrimination result received from the sheet discriminating apparatus 13 to the database server 3.

The database server 3 stores the discrimination information Da received from the main controller 20 for each sheet. The data relating to the shape, the type of note, and the normal sheet/damaged sheet of the sheet is included in the discrimination information Da.

In the data relating to the shape of the sheet, shape detection data which is generated so as to detect the shape based on the transmitted light (a shape detection signal) of the sheet and a shape discrimination result which is obtained by discriminating the shape detection data by shape discriminating means are included.

The above-described shape detection signal is a signal so as to detect the shape state of the sheet, and is obtained by detecting (reading out) the transmission detection signal of the sheet to be conveyed by a line sensor (a CCD and so on) arranged in a direction perpendicular to the conveying direction of the sheet, for example.

The shape detection data is generated by AD converting (Analog to Digital converting) an analog signal outputted from the above-described line sensor, and is written (is stored) into the memory.

The size (length×width) of the sheet is detected from the shape detection data generated in this manner by shape detecting means. Lengths from the front end to the back end in the conveying direction of the sheet are measured at a plurality of places by a prescribed resolution capability (0.1 mm, for example), and a longitudinal size of the sheet can be detected by a method to decide the maximum length as the longitudinal size or a method to decide the average value as the longitudinal size. A crosswise size can be similarly detected.

In addition, from the shape detection data, a normal sheet/damaged sheet amount of the sheet such as a corner folded amount, a size of a hole (a diameter), and an amount of the broken portion is detected by a detection controller (not shown) (first normal sheet/damaged sheet detecting means). With respect to the corner folded amount, for example, an end portion of the sheet is assumed in a case that the corner folded portion does not exist, and the corner folded amount is detected by calculating the corner folded amount (area) by comparing with this. Or as a simplified method, there is a case in which a length of the folded portion of the end face is measured and the value is decided as the corner folded amount.

The amount of the broken portion and the size of the hole can be detected similarly. In this case, there are a case in which a length of the broken portion is measured and the value is decided as the amount of the broken portion and a case in which an area of the broken portion is calculated and the value is decided as the amount of the broken portion, too. In any cases, the detection can be performed if the discrimination method is made the same as a normal sheet/damaged sheet discrimination level described later (first normal sheet/damaged sheet detecting means).

The normal sheet/damaged sheet amounts detected in this manner are discriminated by the detection controller for each item (first normal sheet/damaged sheet discriminating means).

In the data relating to the type of note of the sheet, type of note detection data generated so as to detect the type of note based on an upper face reflected light (a type of note detection signal) and a lower face reflected light (a type of note detection signal) of the sheet, and a type of note discrimination result obtained by discriminating the type of note detection data by type of note discriminating means are included.

The above-described type of note detection signal is a signal so as to discriminate the type of note of the sheet, and is obtained by detecting (reading out) the upper face reflected light and the rear face reflected light of the medium (the sheet) to be detected by a line sensor composed of a color CCD arranged in a direction perpendicular to the conveying direction of the sheet to be conveyed.

The type of note detection data is composed of the upper face reflection data and the lower face reflection data which are generated by AD converting an analog signal composed of the upper face reflected light and the lower face reflected light outputted from the above-described line sensor. By performing the prescribed calculation using these signals as the source signals, upper face type of note detection data and lower face type of note detection data to detect the type of note are obtained from an upper face reflection image and a lower face reflection image. These generated upper face type of note detection data and lower face type of note detection data are written into the memory. In addition, the type of note and the conveying direction of the sheet are discriminated by the detection controller from these upper face type of note detection data and the lower face type of note detection data.

In addition, plane image display means can display (monitor) plane images of the relevant sheet using the relevant upper face type of note detection data and the lower face type of note detection data, respectively. Thus, the plane images expresses the front and rear images of the sheet seen by a light eye composed of the type of note detection data to discriminate the type of note of the sheet.

With respect to the above-described upper face type of note detection data and the lower face type of note detection data, there is a case where the medium to be detected is changed in accordance with the type of note or altered note and so on of the sheet to be handled. In this case, the calculation content to generate the type of note detection signal becomes different in accordance with the type of note detection signal (a color image) of the medium. As the calculation content is not the gist of the present invention, the detail will be omitted, but a simulation to discriminate the type of note is performed separately, and a type of note discriminating algorithm suited to detect the difference of the type of note discriminations is set.

In the data relating to the normal sheet/damaged sheet of the sheet, normal sheet/damaged sheet detection data which is generated to detect the normal sheet/damaged sheet based on the upper face reflected light (the normal sheet/damaged sheet detection signal), the lower face reflected light (the normal sheet/damaged sheet detection signal), and the transmitted light, and a normal sheet/damaged sheet discrimination result which is obtained by discriminating the normal sheet/damaged sheet data by the normal sheet/damaged sheet discriminating means.

The above-described normal sheet/damaged sheet detection signal is a signal to discriminate the normal sheet/damaged sheet of the sheet, and is obtained by detecting the upper face reflected light, the rear face reflected light and the transmitted light of the above-described medium to be detected by a line sensor composed of a color CCD arranged in a direction perpendicular to the conveying direction of the sheet to be conveyed, for example.

The normal sheet/damaged sheet detection data is composed of the upper face reflection data, the lower face reflection data and the transmission data which are generated by AD converting an analog signal composed of the upper face reflected light, the lower face reflected light and the transmitted light outputted from the above-described line sensor. By performing the prescribed calculation using these signals as the source signals, upper face normal sheet/damaged sheet detection data and lower face normal sheet/damaged sheet detection data are obtained by a detection controller (second normal sheet/damaged sheet detecting means). These generated upper face normal sheet/damaged sheet detection data (the normal sheet/damaged sheet amount) and the lower face normal sheet/damaged sheet detection data (the normal sheet/damaged sheet amount) are written into the memory (the second normal sheet/damaged sheet detecting means). In addition, from these upper face normal sheet/damaged sheet detection data and lower face normal sheet/damaged sheet detection data, an entire blot and a partial blot of the sheet are discriminated for each item by the detection controller (the second normal sheet/damaged sheet discriminating means).

In addition, in order to detect the blot soaked through the sheet in addition to the blot on the surface, to use not only the reflected lights composed of the upper face reflected light and the lower face reflected light but also the transmitted light is effective.

The normal sheet/damaged sheet detection data stored in this manner become a surface image data and a rear face image data indicating the degrees of the blots of the sheet seen from the surface and from the lower face of the sheet, respectively.

In addition, the normal sheet/damaged sheet detection of the sheet includes an entire blot detection to detect an entire blot of the sheet and a partial blot detection to detect a partial blot of the sheet. The entire blot detection calculates surface normal sheet/damaged sheet detection data and rear face normal sheet/damaged sheet detection data from the above-described upper face reflected light, the lower face reflected light and the transmitted light. The calculated surface normal sheet/damaged sheet detection data and the rear face normal sheet/damaged sheet detection data are compared with a normal sheet/damaged sheet discrimination level described later to discriminate the entire blot (the second normal sheet/damaged sheet discriminating means).

On the other hand, the partial blot detection detects a partial blot such as graffiti or memorandum written in the watermark portion or the blank portion. The partial blot detection measures, in a case that the graffiti is drawn, a length of the graffiti portion or detects a size of an area in which the graffiti is drawn.

The above-described detection data of each detecting apparatus are comparison discriminated with discrimination levels set preliminarily by each detecting apparatus. With respect to the comparison discriminating method, there are a method to compare simply the above-described detection data with the discrimination level to discriminate, and a method, after a similarity degree calculation is performed between the detection data and a preliminarily set standard pattern using a similarity degree method, to compare the similarity degree value with the discrimination level to discriminate. The former is effective in the case of discriminating the amount of the detection data, and the latter is effective in the case of discriminating the pattern of the sheet.

Figure 3:
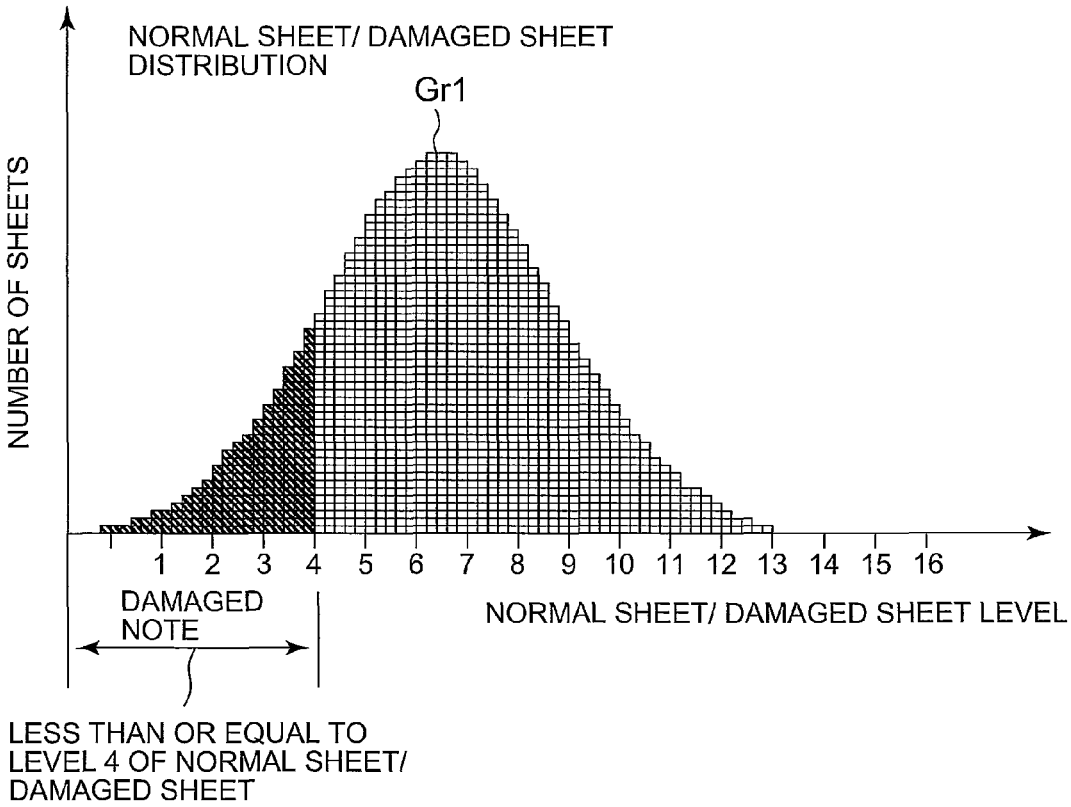
FIG. 3 is a graph showing a histogram of the normal sheet/damaged sheet discrimination data relating to the entire blot.

FIG. 3 shows a distribution (a histogram) of the normal sheet/damaged sheet detection data relating to the entire blot of the handled sheets. The horizontal axis is a normal sheet/damaged sheet level and the longitudinal axis is the number of the sheets. In addition, the horizontal axis shows an example of a case where with respect to the normal sheet/damaged sheet discrimination level, the normal sheet/damaged sheet discrimination levels are set by 16 steps, for example. In the shown example, the greater parts are included in the range of a normal sheet/damaged sheet discrimination level 1 to a normal sheet/damaged sheet discrimination level 13. In addition, the less the blot of the sheet is, the higher value the normal sheet/damaged sheet discrimination data shows. Accordingly, in a case of a set of sheets which are composed of the sheets with the comparatively high quality and clean, the histogram shows the values which are generally shifted to the right side, and in a set of the sheets with much blot the histogram shows the values which are shifted to the left side.

In the shown example, the area in which the sheets are assumed as damaged notes is shown by diagonal lines, in a case where the normal sheet/damaged sheet discrimination data are discriminated by the normal sheet/damaged sheet discrimination level 4.

The histogram differs depending on a country and an area to use the sheets and the type of note of the sheets. That is, in a country where the environment that the sheets are circulated well, and old sheets are effectively collected and are replaced by new sheets is prepared, the sheets with generally high quality are used. In addition, in a case of the type of high denomination note, as the storage situation by person is well, the quality is relatively good, but if this is not the case, the quality of the sheets becomes relatively low.

Conventionally, the normal sheet/damaged sheet discrimination level was set by a manager at the place where the relevant apparatus is installed. In the present embodiment, a normal sheet/damaged sheet image at a limit value of the normal sheet/damaged sheet discrimination level shown in the histogram can be checked with eyes. Hereinafter, the method will be shown.

Figure 4:
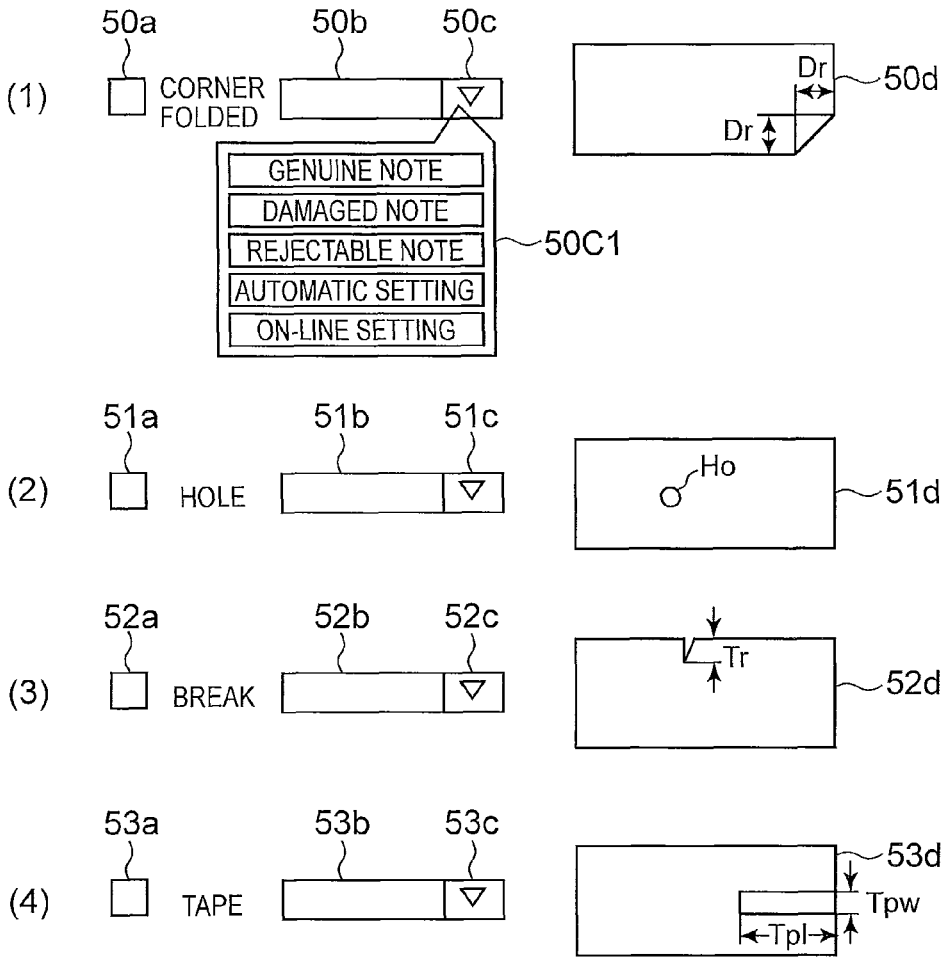
FIG. 4 is a schematic diagram showing windows to set discrimination levels.

FIG. 4 shows windows to set discrimination levels. Hereinafter, one example of the present embodiment will be shown.

FIG. 4(1) is a window to set the discrimination levels for the corner folded. With respect to the discrimination for the corner folded, the sheets are sorted into the genuine note, the damaged note and the rejectable note shown in following expressions (1) to (3) according to a corner folded amount Dr (mm).

$$Dr \leqq 3\text{:genuine note} \quad (1)$$

$$3 < Dr \leqq 10\text{:damaged note} \quad (2)$$

$$10 < Dr\text{:rejectable note} \quad (3)$$

Hereinafter, a method will be shown to set the normal sheet/damaged sheet discrimination levels for the corner folded amount shown in the above expressions (1) to (3).

When a corner folded selection button 50*a* is selected, a configuration 50*d* (a discrimination level display window) of the sheet indicating a discrimination level for the corner folded is displayed on the same window. Continuously, a pull down button 50*c* is clicked, "genuine note" (first setting means) is selected from a selection menu 50*c*1 ("genuine note", "damaged note", "rejectable note", "automatic setting" and "on-line setting") displayed as selecting means, and 3 is inputted to a discrimination level setting column 50*b*. Similarly, "damaged note" (the first setting means) is selected from the selection menu, and 3 and 10 are inputted to the discrimination level setting column 50*b*. Similarly, "rejectable note" (the first setting means) is selected from the selection menu, and 10 is inputted to the discrimination level setting column 50*b*.

By the above inputs, the normal sheet/damaged sheet discrimination levels for the corner folded amount based on the above expressions (1) to (3) can be set.

In addition, by selecting "automatic setting" (second setting means) provided in the above-described selection menu, the normal sheet/damaged sheet discrimination levels for the corner folded amount are automatically set based on setting values which are set separately.

In addition, by selecting "on-line setting" (third setting means) provided in the above-described selection menu, the normal sheet/damaged sheet discrimination levels for the corner folded amount which are set by the central apparatus 100 connected via the network described later can be downloaded.

FIG. 4(2) is a window to set the discrimination levels for the hole. With respect to the discrimination of the hole, the sheets are sorted into the genuine note, the damaged note and the rejectable note shown in following expressions (4) to (6) according to a diameter of the hole Ho (mm).

$$Ho \leqq \phi 2\text{:genuine note} \quad (4)$$

$$\phi 2 < Ho \leqq \phi 8\text{:damaged note} \quad (5)$$

$$\phi 8 < Ho\text{:rejectable note} \quad (6)$$

Hereinafter, a method will be shown to set the normal sheet/damaged sheet discrimination levels for the hole shown in the above expressions (4) to (6). When a hole selection button 51*a* is selected, a configuration 51*d* (a discrimination level display window) of the sheet showing a discrimination level for the hole is displayed on the same window. Continuously, a pull down button 51*c* is clicked, "genuine note" is selected from a displayed selection menu ("genuine note", "damaged note", "rejectable note", "automatic setting" and "on-line setting"), and 2 is inputted to a discrimination level setting column 51*b*. Similarly, "damaged note" is selected from the selection menu, and 2 and 8 are inputted to the discrimination level setting column 51*b*. Similarly, "rejectable note" is selected from the selection menu, and 8 is inputted to the discrimination level setting column 51*b*. "Automatic setting" and "on-line setting" are the same as described above.

FIG. 4(3) is a window to set the discrimination levels for the break. With respect to the discrimination for the break, the sheets are sorted into the genuine note, the damaged note and the rejectable note shown in following expressions (7) to (9) according to a break amount Tr (mm).

$$Tr<3\text{:genuine note} \quad (7)$$

$$3<Tr\leqq 10\text{:damaged note} \quad (8)$$

$$10<Tr\text{:rejectable note} \quad (9)$$

This case can also be set in the same manner as the above-described discrimination level setting method for the corner folded or the hole.

FIG. 4(4) is a window to set the discrimination levels for the tape. With respect to the discrimination for the tape, the sheets are sorted into the genuine note, the damaged note and the rejectable note shown in following expressions (10) to (12), when a tape width Tpw and a tape length Tpl (mm) are indicated as Tpw×Tpl.

$$Tpw\times Tpl\leqq 5\times 5\text{:genuine note} \quad (10)$$

$$5\times 5<Tpw\times Tpl\leqq 10\times 20\text{:damaged note} \quad (11)$$

$$10\times 20<Tpw\times Tpl\text{:rejectable note} \quad (12)$$

This case can also be set in the same manner as the above-described discrimination level setting method for the corner folded or the hole.

Figure 5:
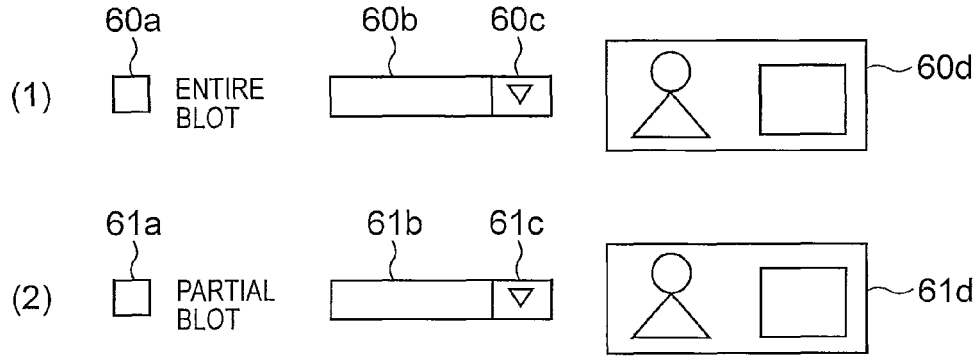
FIG. 5 is a schematic diagram showing windows to set the discrimination levels for the entire blot and the partial blot.

FIG. 5 is windows to set discrimination levels for the entire blot and the partial blot. FIG. 5(1) is a window to set the discrimination level for the entire blot. In the window to set the discrimination level for the entire blot, when a button 60*a* is clicked, a pull down 60*c* becomes selectable. When the pull down 60*c* is selected and 4 is inputted in a discrimination level setting column 60*b*, the normal sheet/damaged sheet discrimination level is set to 4, and a normal sheet/damaged sheet image indicating a limit value (an upper limit value) of the normal sheet/damaged sheet discrimination level 4 is displayed on a reference numeral 60*d*. Similarly, if the normal sheet/damaged sheet discrimination level is set to 5, a normal sheet/damaged sheet image indicating a limit value (an upper limit value) of the normal sheet/damaged sheet discrimination level 5 is displayed on the reference numeral 60*d*. As in this manner, the normal sheet/damaged sheet image can be set while checking with eyes. As a matter of course, it goes without saying that the normal sheet/damaged sheet discrimination level which is checked with eyes can be set directly into the discrimination level setting column 60*b* from a keyboard (not shown) and so on.

FIG. 5(2) is a window to set the discrimination level for the partial blot. In the same manner as the above-described window to set the discrimination level for the entire blot, a normal sheet/damaged sheet image is displayed on a reference numeral 61*d* indicating a limit value (an upper limit value) of the normal sheet/damaged sheet discrimination level in which the normal sheet/damaged sheet level discrimination for the partial blot is set similarly as described above.

With respect to the discrimination for the graffiti, the sheets are sorted into the genuine note, the damaged note and the rejectable note shown in following expressions (13) to (15) according to a length Sc (mm) of the graffiti.

$$Sc\leqq 3\text{:genuine note} \quad (13)$$

$$3<Sc\leqq 10\text{:damaged note} \quad (14)$$

$$10<Sc\text{:rejectable note} \quad (15)$$

The discrimination level for the graffiti can be set in the same manner as the above-described discrimination level setting method for the corner folded or the hole. In addition, in the above-described embodiment, a case is indicated that if a length of the graffiti is larger than 10 (mm) the sheet is dealt with as the rejectable note, but without being limited to this, there is a case that the sheet is discriminated as the damaged note.

Figure 6:
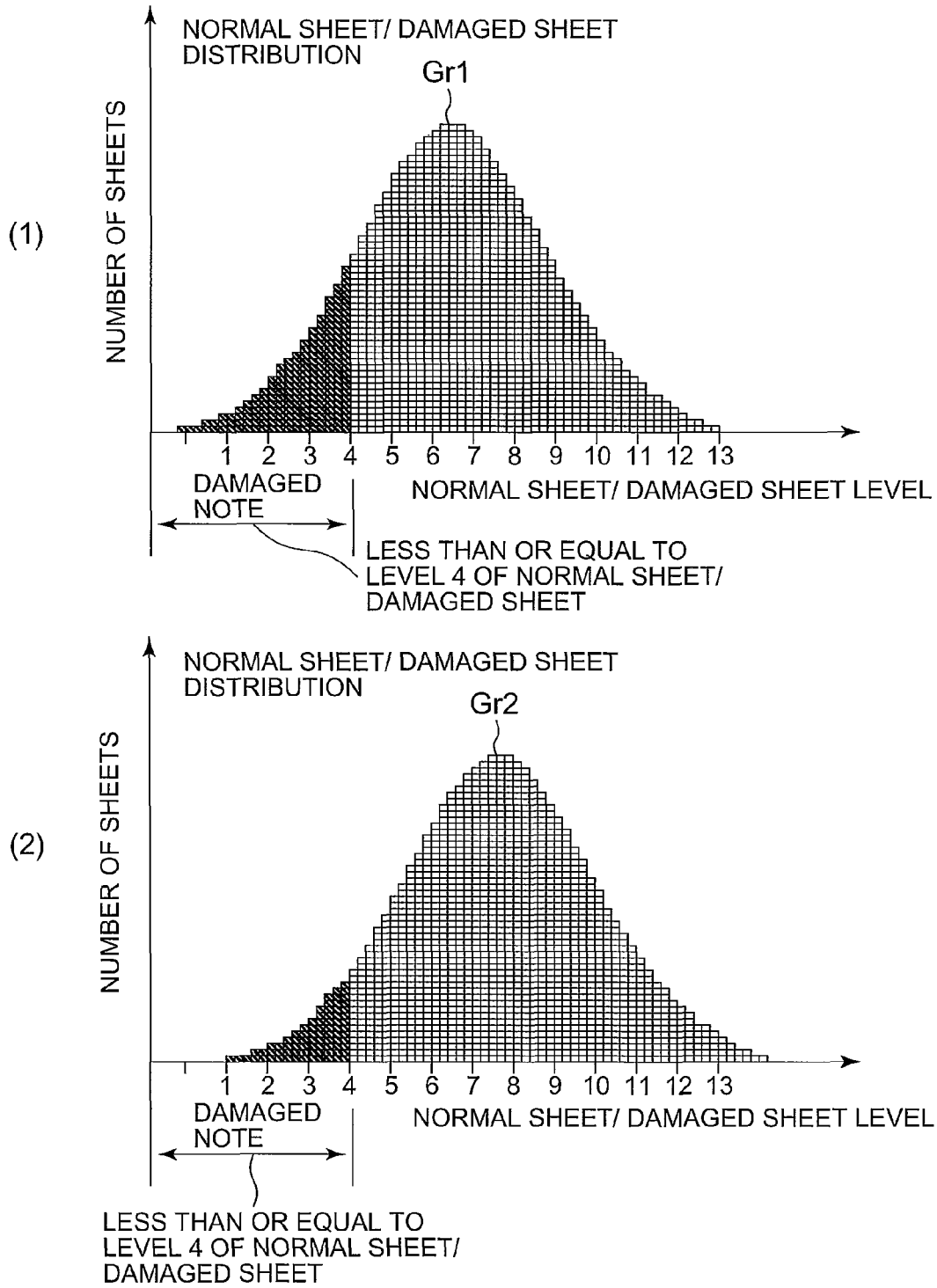
FIG. 6 is a graph showing the normal sheet/damaged sheet distributions of the sheet handling apparatuses arranged at different areas.

FIG. 6 is a view to describe the normalization of the normal sheet/damaged sheet discrimination levels for the entire blot. The normalization process can be performed by a well-known method. The histogram shown in FIG. 6 graphs the number of sheets for the normal sheet/damaged sheet discrimination levels, but if the data to be collected is increased in this state, as the stacked data becomes so large that the data processing becomes difficult, the graph is expressed so that an addition value of the whole data obtained by integrating the number of each the normal sheet/damaged sheet detection data becomes a definite value (1000), for example. The graphs shown in FIG. 7 correspond to this. According to the expression method in this manner, the variation in the quality of the sheets can be expressed regardless of the number of sheets from which data are collected.

The normalization method can be performed by a following expression (16), for example.

$$UNi=(1000/N)Ui\cdot mi \quad (16)$$

N: total number of the normal sheet/damaged sheet discrimination data

Ui: i-th normal sheet/damaged sheet detection data mi: i-th number of sheets (frequency)

UNi: i-th normalized normal sheet/damaged sheet detection data

Figure 7:
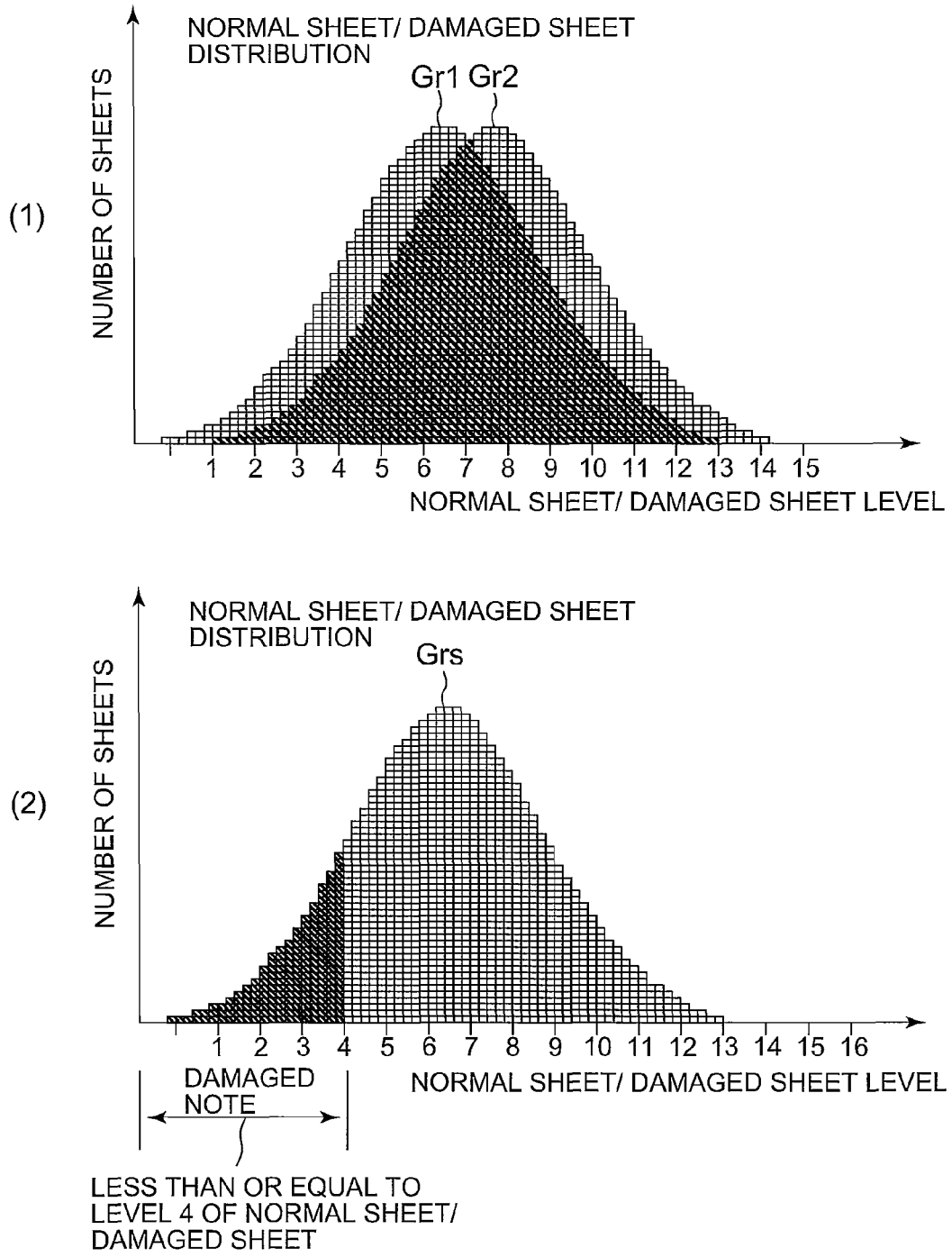
FIG. 7 is a graph showing statistical process of the normal sheet/damaged sheet distributions at the central apparatus.

One which is made by graphing the UNi calculated in this manner with respect to a frequency i is shown in FIG. 7. The above-described normalization (normalize) method is not limited to this, but another method may be used as a method to express the property of the medium well.

As a result, with respect to a first type of note, a normal sheet/damaged sheet distribution (a histogram) Gr1 of the normal sheet/damaged sheet detection data relating to the entire blot at a first area (the sheet handling apparatus 1A1 installed at the branch A, for example), and a normal sheet/damaged sheet distribution (a histogram) Gr2 of the normal sheet/damaged sheet detection data relating to the entire blot which is similarly collected at a second area (the sheet handling apparatus 1B1 installed at the branch B, for example) are generated. Though from another sheet handling apparatus, the normal sheet/damaged sheet distribution is generated by the relevant sheet handling apparatus, here the case that the normal sheet/damaged sheet distributions Gr1 and Gr2 are generated will be described for simplicity. The difference between the normal sheet/damaged sheet distribution Gr1 and the normal sheet/damaged sheet distribution Gr2 arises as the difference between the utilization states of the sheets at the above-described areas.

The normal sheet/damaged sheet distribution Gr2 shifts to the right side compared with the normal sheet/damaged sheet distribution Gr1, and in a case that a normal sheet/damaged sheet discrimination level to sort the normal sheet/damaged sheet is "4", a sheet indicating the normal sheet/damaged sheet detection data of less than or equal to the normal sheet/damaged sheet discrimination level 4 is handled as the damaged note. In the shown example, the number of the damaged notes (a diagonal line portion) of the normal sheet/damaged sheet distribution Gr2 becomes smaller.

The above-described normal sheet/damaged sheet discriminations are performed by the respective sheet discriminating apparatuses for each of the sheet handling apparatuses 1A1 and 1B1. In this case, 20% is handled as the damaged note in the sheet handling apparatus 1A1, on the other hand, 15% is handled as the damaged note in the sheet handling apparatus 1B1, for example. Next, a case that the discrimination level is generated in the central apparatus 100 will be described.

FIG. 7 is a view to indicate a case where the central apparatus 100 generates normal sheet/damaged sheet discrimination levels based on the normal sheet/damaged sheet data transmitted from sheet handling apparatuses installed at each area.

FIG. 7(1) shows a method to generate a normal sheet/damaged sheet discrimination level in a case that the central apparatus 100 receives the normal sheet/damaged sheet detection data from the above-described sheet handling apparatuses 1A1 and 1B1. The FIG. 7(1) shows the normal sheet/damaged sheet distribution Gr1 received from the sheet handling apparatus 1A1 and the normal sheet/damaged sheet distribution Gr2 received from the sheet handling apparatus 1B1 by superimposition.

By combining these normal sheet/damaged sheet distribution Gr1 and normal sheet/damaged sheet distribution Gr2, and by performing the above-described normalization process, a normal sheet/damaged sheet distribution Grs shown in FIG. 7(2) is generated.

In the present embodiment, the normal sheet/damaged sheet distribution Grs is generated based on the normal sheet/damaged sheet distribution Gr1 and the normal sheet/damaged sheet distribution Gr2, but in a case that another sheet handling apparatus is installed and the normal sheet/damaged sheet detection data is transmitted from the relevant sheet handling apparatus, the normal sheet/damaged sheet distribution Grs is generated similarly.

As the normal sheet/damaged sheet distribution generated in this manner expresses the normal sheet/damaged sheet distribution of the whole sheet handling apparatuses installed at the site, a normal sheet/damaged sheet level is set based on the normal sheet/damaged sheet distribution Grs, and a normal sheet/damaged sheet discrimination level is set for the normal sheet/damaged sheet level, the normal sheet/damaged sheet ratios of the sheet handling apparatuses working at the relevant site can be grasped accurately.

Figure 8:
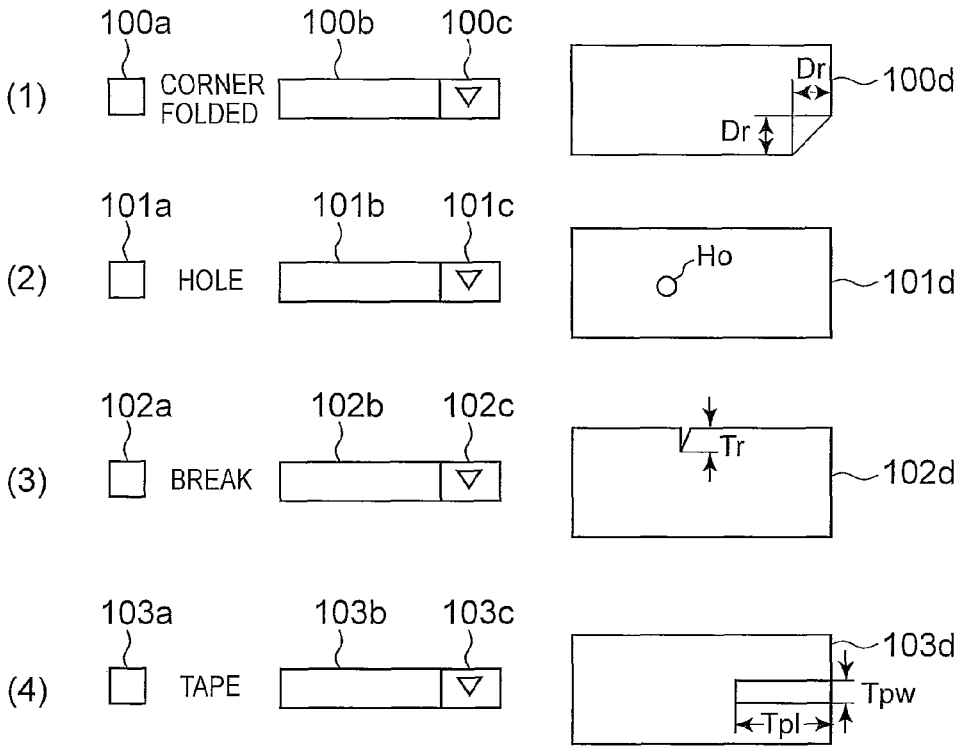
FIG. 8 is a schematic diagram showing windows to set the discrimination levels at the central apparatus.

FIG. 8 is windows to set the discrimination levels in the central apparatus 100. FIG. 8(1) is a window to set the discrimination level for the corner folded. FIG. 8(2) is a window to set the discrimination level for the hole. FIG. 8(3) is a window to set the discrimination level for the break. FIG. 8(4) is a window to set the discrimination level for the tape. These setting windows are the same as the method to set the normal sheet/damaged sheet discrimination in the sheet handling apparatus described in FIG. 4(1) to FIG. 4(4). Accordingly, if the discrimination levels are set from discrimination level setting columns 100*b* to 103*b*, discrimination level displaying windows 100*d* to 103*d* corresponding to the discrimination levels are displayed, respectively.

Figure 9:
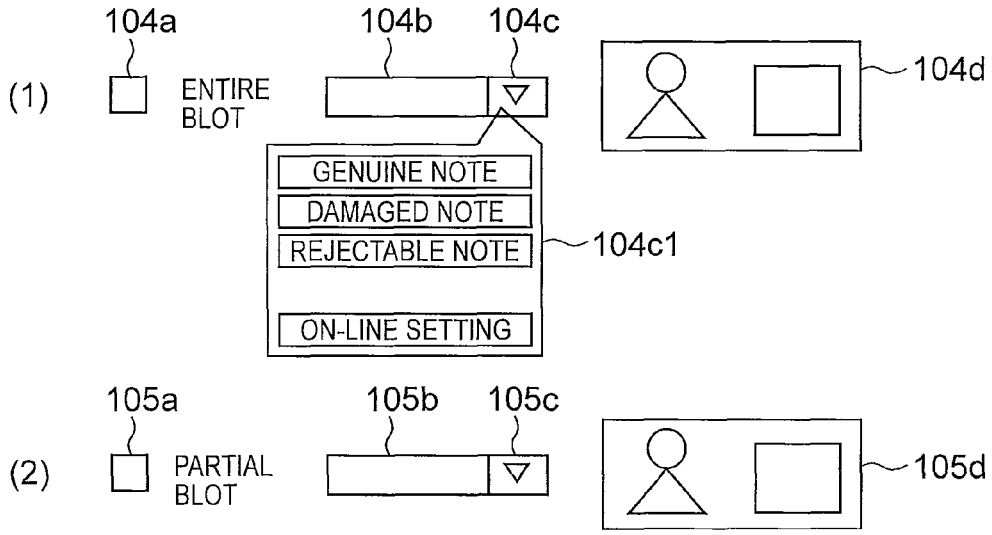
FIG. 9 is a schematic diagram showing windows to set the discrimination levels for the entire blot and the partial blot.

FIG. 9 is windows to set the discrimination levels for the entire blot and the partial blot. FIG. 9(1) is a window to set the discrimination level for the entire blot, and FIG. 9(2) is a window to set the discrimination level for the partial blot. As these setting windows are the same as the method to set normal sheet/damaged sheet discrimination in the sheet handling apparatus 1 described in FIG. 5(1) and FIG. 5(2), the description of the same portion will be omitted.

The example shown in FIG. 4 or FIG. 5 indicates a case to set the discrimination level based on the detection data of the sheets handled by the sheet handling apparatus 1, but the example shown in FIG. 8 or FIG. 9 differs in a point that the discrimination level is set based on the detection data of the sheets transmitted from the sheet handling apparatuses at each site to the central apparatus 100.

In addition, "on-line setting" (second setting means) is selected out of the selection menu as the selection means which is displayed in a case that pull down buttons 100*c* to 103*c*, or 104*c*, 105*c* shown in FIG. 8 or FIG. 9 showing the method to set the discrimination levels at the central apparatus 100 are clicked, the discrimination levels are automatically set.

For example, in a case that the pull down button 104*c* relating to the entire blot shown in FIG. 9(1) is clicked, and "on-line setting" is selected from a displayed selection menu 104*c*1, a normal sheet/damaged sheet discrimination level is automatically set by 16 steps statistically for the distribution obtained by normalizing the detection data for the entire blot which are transmitted form the sheet handling apparatuses installed at each site. In addition, a discrimination level displaying window is displayed on 104*d* corresponding to the normal sheet/damaged sheet discrimination level.

Similarly, in a case that "on-line setting" (the second setting means) is selected out of the selection menu as the selection means displayed when the pull down button 105*c* relating to the partial blot shown in FIG. 9(2) is clicked, similarly a normal sheet/damaged sheet discrimination level is automatically set statistically for the distribution obtained by normalizing the detection data for the partial blot which are transmitted from the sheet handling apparatuses installed at each site. In addition, a discrimination level displaying window 105*d* is displayed corresponding to the normal sheet/damaged sheet discrimination level.

In the present embodiment, in order to use the discrimination level set by the central apparatus at the sheet handling apparatus installed at each site, to click the pull down button 60*c* shown in FIG. 5 and to select "on-line setting" out of the displayed selection menu ("genuine note", "damaged note", "rejectable note", "automatic setting" and "on-line setting") are necessary. By performing this setting, to perform the normal sheet/damaged sheet discrimination at the relevant sheet handling apparatus using the normal sheet/damaged sheet discrimination level set by the central apparatus becomes possible, for example.

Next, an updating timing for the discrimination level of the sheet handling apparatus will be described. The normal sheet/damaged sheet detection data, for example, are transmitted on-line from the sheet handling apparatuses installed at each site to the central apparatus 100. The transmitted normal sheet/damaged sheet detection data is collected by the above-described method, and a new normal sheet/damaged sheet discrimination level is set based on the above-described statistical processing.

Even in the normal sheet/damaged sheet discrimination level set in this manner the effect can not be obtained unless the normal sheet/damaged sheet discrimination level of the relevant sheet handling apparatus is not updated arbitrarily. In the present embodiment, when the main power source of the sheet handling apparatus is turned ON, or at a time when the handling of the former sheet bundle is finished and the initializing process, such as, the type of note setting, the stacker setting and the amount to be handled is performed so as to handle the next sheet bundle, an inquiry for the update information is made to the relevant central apparatus 100, and if there is the up-to-date normal sheet/damaged sheet discrimination level stored in the database server 103 of the central apparatus 100 information, downloading is performed.

The above-described updating method is not limited to this, but an updating button for the normal sheet/damaged sheet discrimination level is provided on the operating window of the above-described operation display, and updating can be performed by the updating button. In any cases, the sheet handling apparatus is in the operating state, but updating becomes possible automatically or by the input operation of an operator before conveying the sheets is started.

In the above-described embodiment, a sheet handling system is described in which the central apparatus 100 is provided at the central branch, the sheet handling apparatuses 1A1, 1A2, 1A3 are provided at the branch A, the sheet handling apparatuses 1B1, 1B2 are provided at the branch B, and these are mutually connected to the network 50. The present invention is not limited to this, but may be a sheet handling system in which the central apparatus 100 is provided at a central bank, the sheet handling apparatuses 1A1, 1A2, 1A3 are provided in an A bank, the sheet handling apparatuses 1B1, 1B2 are provided in a B bank, and these are mutually connected to the network 50.

DESCRIPTION OF THE REFERENCE NUMERALS

P sheet
1 sheet handling apparatus
1A1, 1A2, 1A3 sheet handling apparatus installed at branch A
1A4 LAN
1B1, 1B2, 1B3 sheet handling apparatus installed at branch B
1B4 LAN
2 higher rank apparatus
3 database server
13 sheet discriminating apparatus
14 to 17 stacking/banding device
20 main controller
21 conveyor controller
30 conveyor
50 network
100 central apparatus
103 database server

The invention claimed is:

1. A sheet handling system comprising:

a sheet handling apparatus communicatively coupled, via a network, to a central apparatus that is remotely installed from the sheet handling apparatus, wherein, the sheet handling apparatus includes:

a selection unit configured to select any one of a genuine note, a damaged note, a rejectable note, an automatic setting, and an on-line setting to discriminate a sheet;

a first setting component configured to set a discrimination level for each of the genuine note, the damaged note, or the rejectable note selected by the selection unit;

a second setting component configured to automatically set a discrimination level of the genuine note, the damaged note, and the rejectable note based on detection data detected by the sheet handling apparatus, when the automatic setting is selected;

a third setting component configured to request the central apparatus to transmit a discrimination level via the network, to receive the discrimination level transmitted from the central apparatus, and to set the discrimination level, when the on-line setting is selected; and a sheet discriminating mechanism configured to discriminate the sheet to be conveyed based on the discrimination level set by the first setting component, the second setting component, or the third setting component; and wherein, the central apparatus includes:

a central selection unit configured to select any one of the genuine note, the damaged note, the rejectable note, and the on-line setting to discriminate the sheet;

a central first setting component configured to set a discrimination level for each of the genuine note, the damaged note, or the rejectable note selected by the central selection unit;

a central second setting component configured to automatically set a discrimination level of the genuine note, the damaged note, and the rejectable note based on the detection data received from the sheet handling apparatus via the network, when the on-line setting is selected;

a selection unit configured to select between the discrimination level set by the central first setting component or the central second setting component; and a transmission mechanism configured to transmit, via the network, the discrimination level selected by the selection unit, in response to the sheet handling apparatus transmission request for the discrimination level.

2. The sheet handling system of claim 1, wherein the sheet handling apparatus is provided with an updating mechanism configured to:

request the central apparatus to transmit an up-to-date discrimination level after a power source of the sheet handling apparatus is turned ON or when performing an initializing process for the handling of a subsequent sheet bundle, and update a former discrimination level to the up-to-date discrimination level, when the up-to-date discrimination level is transmitted in response to the request.

3. The sheet handling system of claim 1, wherein the central apparatus is further connected to a database server configured to:

store data relating to attributes of each of the sheets, the attributes being transmitted from the sheet handling apparatus and include a type of note and the number of the sheets, a normal sheet/damaged sheet discrimination result, and an issue year of the sheets, calculate and further store data regarding a ratio of the genuine notes and the damaged notes, and a ratio of counterfeit notes, display the stored data on an operation display of the central apparatus, and transmit the data in accordance with the transmission request from the sheet handling apparatus.

* * * * *